US006480171B1

(12) United States Patent
Huang

(10) Patent No.: US 6,480,171 B1
(45) Date of Patent: Nov. 12, 2002

(54) IMPEDANCE MATCHING MEANS BETWEEN ANTENNA AND TRANSMISSION CABLE

(75) Inventor: Chien-Shun Huang, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/045,305

(22) Filed: Oct. 26, 2001

(51) Int. Cl.[7] ..... H01Q 1/50

(52) U.S. Cl. ..... 343/860; 343/700 MS; 343/850; 343/895

(58) Field of Search ..... 343/700 MS, 702, 343/725, 729, 850, 860, 895, 829, 846; H01Q 1/50

(56) References Cited

U.S. PATENT DOCUMENTS 6,127,978 A * 10/2000 Uematsu et al. ..... 343/700 MS
6,133,883 A * 10/2000 Munson et al. ..... 343/700 MS
6,288,679 B1 * 9/2001 Fischer et al. ..... 343/700 MS
6,307,525 B1 * 10/2001 Bateman et al. ..... 343/853
6,177,872 B1 * 1/2002 Kodukula et al. ..... 340/572.7
6,195,049 B1 * 2/2002 Kim et al. ..... 343/700 MS
6,346,913 B1 * 2/2002 Chang et al. ..... 343/700 MS
6,198,437 B1 * 3/2002 Watson et al. ..... 343/700 MS

* cited by examiner

*Primary Examiner*—Tho Phan
(74) *Attorney, Agent, or Firm*—Wei Te Chung

(57) ABSTRACT

An impedance matching means (3) according to the present invention is used with a printed wire board (PWB) antenna. The PWB antenna includes a PWB (1) having an upper side (11) and a lower side (12), and an antenna body (2) having a radiating portion (21), a feed portion (22), and a ground portion (23). A transmission cable is connected to the antenna body with its inner conductor soldered to the feed portion and its outer shield soldered to the ground portion. The matching means has a first conductive patch (5), which is electrically connected to the feed portion, and a second conductive patch (6), which may or may not be electrically connected to the ground portion. The first and the second conductive patches are disposed in parallel, one on the upper side and one on the lower side of the PWB, and thus sandwich a portion of the PWB therebetween.

12 Claims, 2 Drawing Sheets

IMPEDANCE MATCHING MEANS BETWEEN ANTENNA AND TRANSMISSION CABLE

FIELD OF THE INVENTION

The present invention relates generally to an impedance matching means, and more particularly to an impedance matching means between an antenna and a transmission cable.

BACKGROUND OF THE INVENTION

The continuing growth in wireless communications has spurred the demand for more radio frequency (RF) antennas for use in notebooks, portable handsets, and other products. When employing an RF antenna, it is important to match the impedance of the RF antenna load to the impedance of the antenna feed cable, especially when the antenna is fed by an unbalanced transmission cable, such as a coaxial cable. Coaxial cables are normally designed to provide a 50 ohm or a 75 ohm normative resistance to the antenna. However, the input impedance of the antenna will be changed by the antenna attachment mechanism. It is often found that the input impedance of the antenna is non-matching when measured from the coaxial cable feed point.

The input impedance of an antenna can be expressed by $Z_i=R_A+_jX_A$, wherein $R_A$ and $X_A$ are respectively the real and imaginary parts of the input impedance. In order to attain favorable antenna radiating efficiency, the loss produced by the imaginary part $X_A$ must be eliminated. It is conventional to use a balun, such as a quarter wavelength balun, to perform impendence matching of an antenna. The balun prevents asymmetrical loading of the antenna and a concurrent induction of a current on the exterior of the unbalanced transmission cable. Impedance matching is achieved by designing the real part $R_A$ of the antenna load to be substantially equivalent to the characteristic impedance of the transmission cable, while at the same time, selecting the impedance of the balun to offset the imaginary part $X_A$ of the antenna load. However, complex calculations are needed to predetermine where the balun should be disposed in the antenna.

Hence, an improved impedance matching means between an antenna and a transmission cable is needed.

BRIEF SUMMARY OF THE INVENTION

A primary object of the present invention is to provide a convenient impedance matching means between an antenna and a transmission cable.

An impedance matching means according to the present invention is used with a printed wire board (PWB) antenna. The PWB antenna includes a PWB comprising an upper side and a lower side, with an antenna body printed on the upper side. The antenna body comprises a radiating portion, a feed portion, and a ground portion. A transmission cable is connected to the antenna body with its inner conductor soldered to the feed portion and its outer shield soldered to the ground portion. The impedance matching means is electrically connected to the feed portion and to the ground portion and includes a first conductive patch and a second conductive patch. The first and the second conductive patches are disposed parallel to one another on the upper side and on the lower side of the PWB, with the PWB sandwiched therebetween. The impedance of the antenna can be conveniently predetermined to match a preselected cable by either changing the relative areas of the two patches or by changing the relative permitivity of the dielectric material of the PWB.

Other objects, advantages and novel features of the invention will become more apparent from the following detailed description when taken in conjunction with the accompanying drawings.

DETAILED DESCRIPTION OF THE INVENTION

Figure 1:
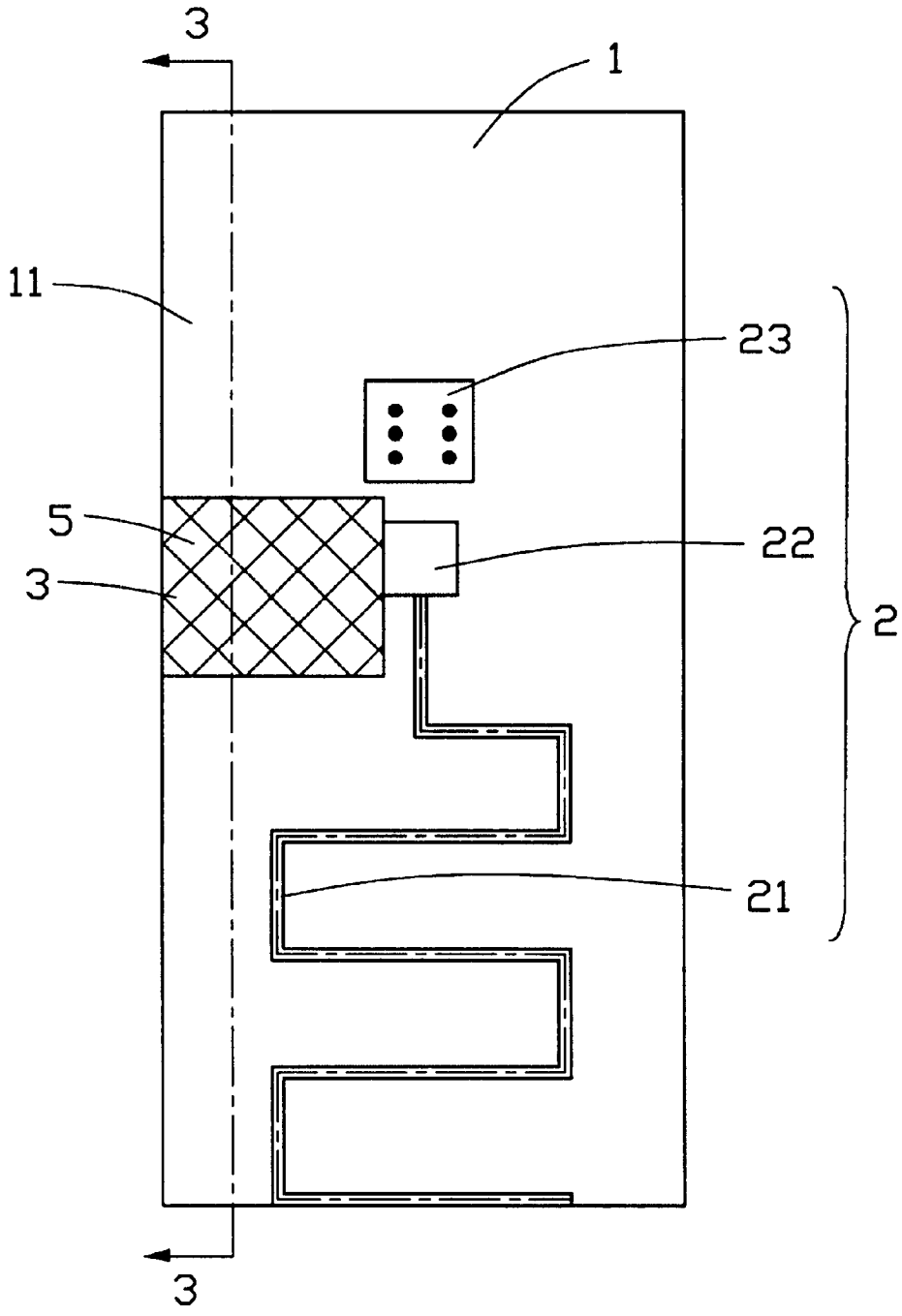
FIG. 1 is a top view of a printed wire board (PWB) antenna with an impedance matching means according to the present invention.
Figure 2:
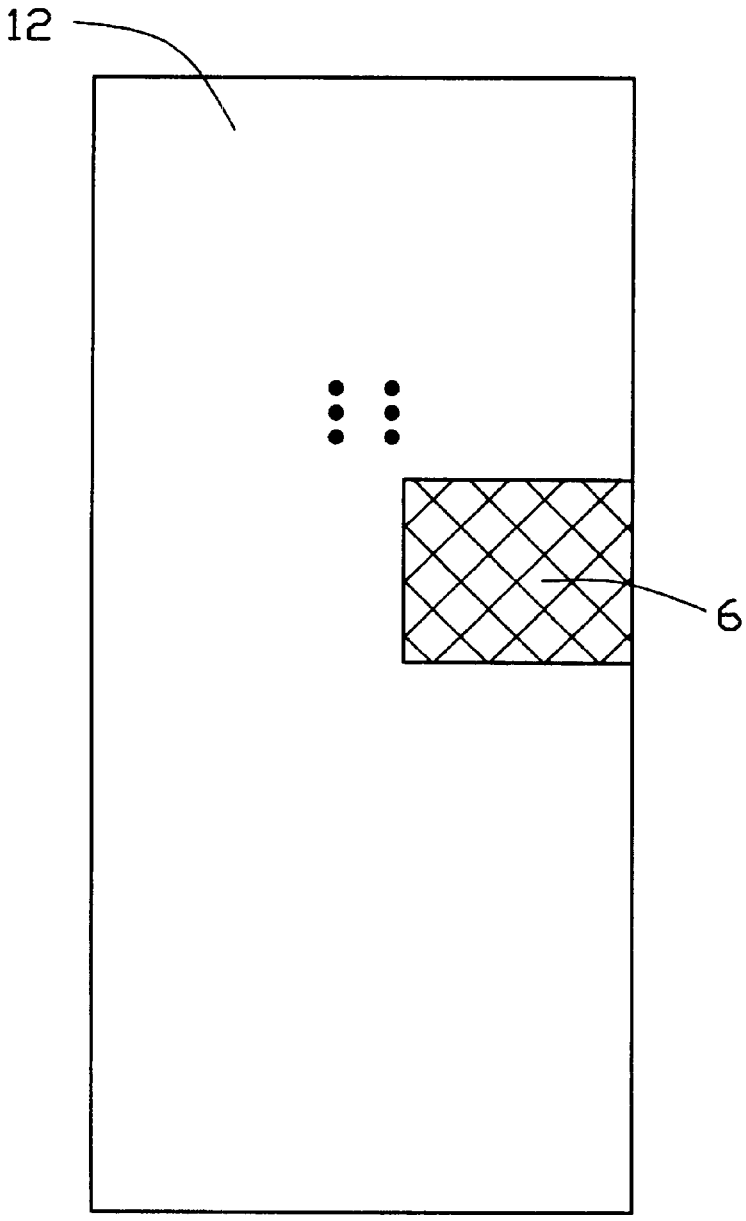
FIG. 2 is a bottom view of the PWB antenna of FIG. 1.
Figure 3:
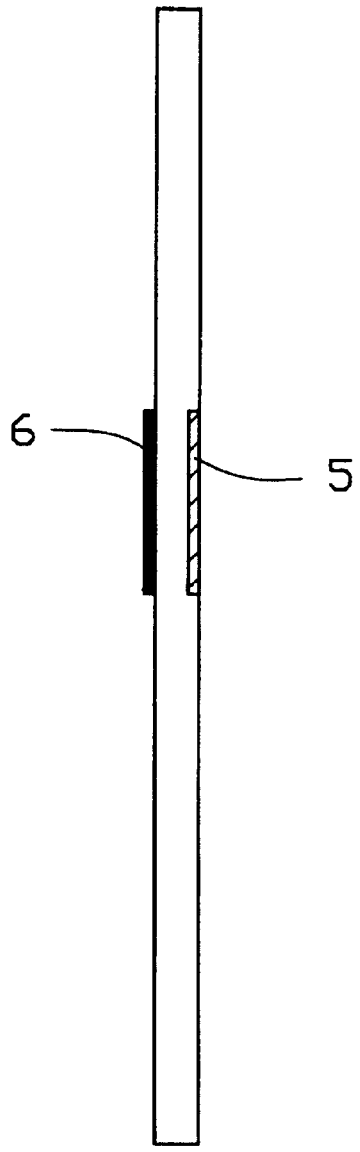
FIG. 3 is a cross-sectional view of the PWB antenna taken along a dash-dotted line 3—3 of FIG. 1.

Referring to FIGS. 1–3, an impedance matching means 3 according to the present invention is meant for use, typically, with a printed wire board (PWB) antenna (not labeled). The PWB antenna includes a dielectric PWB 1 and an antenna body 2 disposed on the PWB 1.

The PWB 1 is typically a rectangular FR4 board including two main opposing sides, namely, an upper side 11 and a lower side 12.

The antenna body 2 is disposed on the upper side 11 of the PWB 1 and includes a radiating portion 21, a feed portion 22, and a ground portion 23. In this embodiment, the feed portion 22 is a metal pad disposed substantially at a middle part of the PWB 1. The radiating portion 21 is a serpentine-form conductor trace meandering from the feed portion 22 to an edge of the upper side 11 and is in electrical contact with the feed portion 22. The ground portion 23 is disposed to a side of and is electrically isolated from the feed portion 22. The ground portion 23 is used as a ground solder pad.

The impedance matching means 3 includes a pair of parallel patches, namely, a first conductive patch 5 and a second conductive patch 6, separated by a portion of the PWB 1. The first conductive patch 5 is electrically connected to the feed portion 22 of the antenna body 2, while the second conductive patch 6 may or may not be electrically connected to the ground portion 23. The first conductive patch 5 and the second conductive patch 6 are respectively disposed upon the upper side 11 and the lower side 12 of the PWB 1. In this embodiment, the conductive patches 5, 6 are copper patches disposed upon the PWB 1 by etching processes and the first conductive patch 5 abuts against an edge of the feed portion 22. An additional critical component of the impedance matching means 3 is the portion of the PWB 1 that is sandwiched between the two conductive patches 5, 6.

In use, a transmission cable (not shown) having an inner conductor and an outer shield is electrically connected to the PWB antenna (not labeled) with the inner conductor soldered to the feed portion 22 and the outer shield soldered to the ground portion 23 of the antenna body 2. The PWB antenna's input impedance as seen at the feed portion 22 and the ground portion 23 is conveniently predetermined by adjusting the relative areas of the two conductive patches 5, 6, and also by selecting a dielectric material for the PWB 1 which has a desired relative permittivity. A change in relative permittivity of the dielectric material of the PWB 1, will of course, alter the electrical effects induced on the antenna body 2 by the two conductive patches 5, 6 by altering the electrical characteristics of the material between the two conductive patches 5, 6.

It is to be understood, however, that even though numerous, characteristics and advantages of the present invention have been set forth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An impedance matching means for performing impedance matching between an antenna and a transmission cable, wherein the antenna is a printed wire board (PWB) antenna including an antenna body on a dielectric PWB, and wherein the antenna body has a radiating portion connected to a feed portion, and a ground portion electrically insulated from the radiating and feed portions, said impedance matching means comprising: a first conductive patch and a second conductive patch arranged parallel to one another and disposed upon opposing sides of the PWB, the first conductive patch being electrically connected to the feed portion of said antenna body.

2. The impedance matching means according to claim 1, wherein the second conductive patch is electrically connected to the ground portion of said antenna body.

3. The impedance matching means according to claim 1, wherein the first and second conductive patches are copper patches disposed upon the PWB by etching processes.

4. The impedance matching means according to claim 1, wherein the relative areas of the first and second conductive patches are predetermined to perform the impedance matching function.

5. The impedance matching means according to claim 1 wherein a permittivity of a dielectric material of which the dielectric PWB is made to perform the impedance matching function.

6. An antenna assembly for connection to a transmission cable having an inner core conductor and an outer conductive shield, comprising:

a dielectric printed wire board (PWB) having an upper side and a lower side;

an antenna body disposed on the upper side of the PWB, including:

a radiating portion;

a feed portion electrically connected to the radiating portion; and a ground portion electrically insulated from the feed portion and the radiating portion; and an impedance matching means, comprising:

a first conductive patch on the upper side of the PWB; and a second conductive patch on the lower side of the PWB, the second conductive patch being electrically insulated from the first conductive patch by the intervening PWB; and whereby the inner core conductor of the transmission cable electrically connects to the feed portion and the shield of the transmission cable electrically connects to the ground portion, the radiating portion transmits and receives electromagnetic signals, and the impedance matching means effectively matches an input impedance of the antenna assembly to an impedance of the transmission cable.

7. The antenna assembly of claim 6, wherein the second conductive patch is electrically connected to the ground portion.

8. The antenna assembly of claim 6, wherein the input impedance of the antenna assembly is changed by changing relative areas of the first conductive patch and the second conductive patch.

9. The antenna assembly of claim 6, wherein the input impedance of the antenna assembly is changed by changing a relative permittivity of a dielectric material of which the PWB is composed.

10. The antenna assembly of claim 6, wherein the radiating portion has a serpentine form.

11. A method of making an RF antenna assembly, comprising the steps of:

providing a printed circuit board defining two opposite surfaces;

forming spaced feed portion and grounding portion on one of said surface;

forming a properly configured radiation portion on the same one of said surfaces, said radiation portion electrically connected to said feed portion.;

providing a pair of parallel conductive patches on said two opposite surfaces, respectively with one of said pair of conductive patches electrically connected to said feed portion; wherein by adjusting relative areas of the patches or changing a relative permittivity of a dielectric material of the printed circuit board between said pair of patches, an impedance of the antenna is matched that of a preselected cable which is electrically connected to the feed portion.

12. The method of claim 11, wherein said pair of patches have the similar shape and dimension with each other, and symmetrically arranged relative to said printed circuit board.

* * * * *